US006491098B1

(12) United States Patent
Dallas

(10) Patent No.: US 6,491,098 B1
(45) Date of Patent: Dec. 10, 2002

(54) METHOD AND APPARATUS FOR PERFORATING AND STIMULATING OIL WELLS

(76) Inventor: L. Murray Dallas, 790 River Oaks Dr., Fairview, TX (US) 75069

( * ) Notice: Subject to any disclaimer, the term of this patent is extended or adjusted under 35 U.S.C. 154(b) by 1 day.

(21) Appl. No.: 09/707,739

(22) Filed: Nov. 7, 2000

(51) Int. Cl.[7] ..... E21B 43/11
(52) U.S. Cl. ..... 166/297; 166/299; 166/55.1
(58) Field of Search ..... 166/297, 298, 166/263, 282, 308, 299, 55.1

(56) References Cited

U.S. PATENT DOCUMENTS

| | | | | | |
|---|---|---|---|---|---|
| 2,986,214 | A | * | 5/1961 | Wiseman et al. | 102/310 |
| 3,066,736 | A | * | 12/1962 | Venghiattis | 102/310 |
| 3,612,189 | A | * | 10/1971 | Brooks et al. | 166/297 |
| 3,902,361 | A | | 9/1975 | Watson | 73/151 |
| 4,529,038 | A | * | 7/1985 | Brieger | 166/312 |
| 4,598,776 | A | | 7/1986 | Stout | 175/4.54 |
| 5,070,943 | A | * | 12/1991 | Walker et al. | 166/297 |
| 5,513,703 | A | * | 5/1996 | Mills et al. | 166/316 |
| 5,865,252 | A | | 2/1999 | Van Petegem et al. | 166/297 |
| 6,084,403 | A | | 7/2000 | Sinclair et al. | 324/221 |
| 6,116,343 | A | | 9/2000 | Van Petegem et al. | 166/297 |
| 6,286,598 | B1 | * | 9/2001 | van Petegem et al. | 166/297 |
| 6,289,991 | B1 | * | 9/2001 | French | 166/208 |

* cited by examiner

*Primary Examiner*—David Bagnell
*Assistant Examiner*—Daniel P Stephenson
(74) *Attorney, Agent, or Firm*—Nelson Mullins Riley & Scarborough, LLP

(57) ABSTRACT

Perforation and stimulation of a plurality of selected sections of a cased well is completed with a single insertion of a well tool. The process includes successive stages of perforating and stimulating selected sections of the well in sequence starting from a lowest section in the wellbore. In each stage, selected charges carried by a perforating gun of the well tool are detonated to perforate the casing and stimulation fluid is pumped through the perforating gun to an injection nozzle connected to a bottom end of the perforating gun.

24 Claims, 6 Drawing Sheets

METHOD AND APPARATUS FOR PERFORATING AND STIMULATING OIL WELLS

CROSS-REFERENCE TO RELATED APPLICATIONS

This is the first application filed for the present invention.

MICROFICHE APPENDIX

Not applicable.

TECHNICAL FIELD

The present invention relates in general to the preparation of subterranean wells for the production of fluids from underground reservoirs and, in particular, to tools used in subterranean wells for casing perforation and production stimulation.

BACKGROUND OF THE INVENTION

As the supply of highly-productive hydrocarbon wells is exhausted, there is increasing interest in producing hydrocarbon fluids from potentially productive geological formations that contain sufficient volume of such fluids, but have low permeability so that production is slow or difficult. In order to economically produce fluids from such formations, the formations must be artificially "stimulated" to increase the permeability of the production zone. Many methods have been invented for artificially stimulating subterranean formations. Generally, such methods are referred to as "well fracturing". During well fracturing, pressurized fluids are pumped through perforations in a well casing and into a production zone in order to break or fracture pores in the zone to improve permeability so that the hydrocarbon fluids can drain from the production zone into the casing. Those pressurized fluids are often laden with abrasive "proppants", such as sharp sand. In order to stimulate a new well, it is first necessary to perforate a casing of the well. This is generally accomplished using what is known in the art as "perforating guns" such as taught, for example, in U.S. Pat. No. 4,598,776 which issued on Jul. 8, 1986 to Stout. After the casing is perforated, a fracturing tool is lowered into the well and fluids pressurized to 5,000–10,000 psi are pumped through the perforations into the formation. The high pressures tend to break up the formations to release trapped hydrocarbon fluids. The proppants infiltrate the formation and prevent collapse after the high stimulation pressure is released.

In order to increase the efficacy of the stimulation process, "staged well stimulation" methods have been developed. In staged stimulation, small sections of a production zone are fractured in sequence by isolating sections of the production zone or, if the production zone is very small, isolating the entire production zone in order to concentrate the area to which stimulation fluids are delivered. This helps ensure that a production zone is more evenly fractured. It is common practice today to perforate all of the production zones through which a casing extends. Tubing is then run into the well with isolation packers to isolate a section of a zone to be stimulated. Generally, about 10 feet (3.3 meters) of a zone is isolated at a time using isolation packers and a small fracturing treatment is applied to that section of the zone. Thereafter, the tubing is moved up and another small fracturing treatment is performed. This process is repeated until all of the production zones in the well have been stimulated.

A disadvantage of the way in which the staged stimulation process is performed is that if a condition known as "screenout" occurs, the entire toolstring must be pulled from the well in order to clean the apparatus and recommence the stimulation. Screenout is a phenomenon that occurs when abrasive proppants clog the injection tubing during a fracturing process.

Furthermore, if all of the production zone(s) are already perforated, and there are open perforations above the upper isolation packer, fracturing fluids may migrate upwards through a production zone outside the casing and enter the casing above the upper isolation packer. This can cause the casing to fill with high pressure fluid and proppants. This has two disadvantages. First, the casing above the upper isolation packer may fill with abrasive proppant and trap the tool within the casing. Second, the fracturing of one or more sections may be ineffective because the fracturing fluids follow a path of least resistance and the entire production zone is not uniformly fractured.

Some of these problems with prior art methods of staged well stimulation are overcome by inventions described in U.S. Pat. Nos. 5,865,252 and 6,116,343 which issued respectively on Feb. 2, 1999 and Sep. 12, 2000 to Van Petegem et al. These patents describe a method and apparatus for a one-trip production zone perforation and proppant fracturing operation carried out using a workstring-supported perforation gun lowered into a casing nipple located in the production zone. Firing of the perforation gun creates spaced apart aligned sets of perforations extending outwardly through a side wall portion of the workstring, the nipple, cement surrounding the nipple and into the production zone. After firing, the gun falls into and is retained in an underlying gun catcher portion of the workstring. Proppant slurry is then pumped down the workstring and out through the side wall perforations, and through the aligned perforations in the nipple to stimulate the production zone. After stimulation of the production zone, the workstring and the spent perforation gun that it retains are pulled up out of the casing.

While this method represents an advance over the prior art, it still has several disadvantages. First, the purpose of the invention is to enable a one-trip entry run into the well to perform perforation as well as stimulation. In order to make the one-trip into the well profitable, a significant length of the nipple must be perforated and stimulated in a single shot. Consequently, if the perforated area is very large, the production zone may not be evenly stimulated. In other words, this tool is not suited for economical staged stimulation.

Furthermore, the perforating gun is designed for single-shot operation. As described above, after the perforating gun is fired, it is dropped into a gun-catching section of the toolstring. Because of this, only one contiguous region of a casing can be perforated each time the tool is run into the well. Consequently, the tool must be run into the well at least once for each production zone requiring stimulation. This is time-consuming and contributes to the cost of production from the well. A further disadvantage is the fact that a perforating gun must be customized for each production zone. While this is commonplace for wireline applications, it is more difficult and time-consuming when the perforating gun must be incorporated into a toolstring between well perforation/stimulation operations.

There therefore exists a need for a method and apparatus that permits selective perforation and stimulation of staged sections of a production zone while ensuring an even and complete distribution of fracturing fluids within each stage of the production zone treated.

There is also a need for a method and apparatus that permits a plurality of production zones, or stages in a production zone to be successively perforated and stimulated without withdrawing a toolstring from the well.

SUMMARY OF THE INVENTION

It is therefore an object of the invention to provide a method and apparatus for conducting subterranean well casing perforation and production zone stimulation using a process that saves time and reduces costs.

It is a further object of the invention is to provide a well tool for perforating and stimulating subterranean wells so that both a staged perforating process and a staged stimulation process can be completed using the well tool in a one-trip insertion of the tool into the well.

It is another object of the invention to provide a well tool for selectively perforating and stimulating subterranean wells so that the perforation of several selected sections of a well casing and the stimulation of several corresponding sections of one or more subterranean production zones can be completed using the well tool in a one-trip insertion of the tool into the well.

It is a further object of the invention to provide a method for completing perforation and stimulation of selected sections of a subterranean well using a well tool adapted to perform staged perforation and fracturing in a one-trip insertion of the tool into the well.

In general terms, these objects are achieved by pumping production stimulation fluid through a novel perforating gun to an injection nozzle connected to a lower end of the gun.

In accordance with one aspect of the invention, an apparatus is provided for perforating and stimulating subterranean wells, such as oil wells, which comprises a perforating gun for perforating a well casing, the perforating gun being adapted for connection of a tubing string and including a fluid passage to permit well stimulation fluid to be pumped therethrough without affecting functionality of components of the gun; and an injection nozzle connected to a second end of the perforating gun in fluid communication with the fluid passage for injecting pressurized stimulation fluid into a production zone through perforations made through a casing of the well by the perforating gun.

The charges of the perforating gun are preferably adapted to be selectively detonated so that perforations in selected sections of the well casing can be effected by a single perforating gun. The injection nozzle preferably includes an annular seal attached to a bottom end of the nozzle for sealing an annulus between the apparatus and the well casing to prevent pressurized stimulation fluid from flowing into the well casing below the apparatus. In order to balance fluid pressure on each side of the annular seal when the apparatus is inserted into the well, it is preferable to provide a fluid passage having a check valve in the injection nozzle to permit fluid in the well below the annular seal to flow through the injection nozzle when the apparatus is inserted into the well, while inhibiting the pressurized stimulation fluid from flowing through the nozzle into the well casing below the apparatus.

In accordance with one embodiment of the invention, the perforating gun includes a tubular sleeve and an inner mandrel which define an annulus to accommodate charges carried by the perforating gun. The injection nozzle includes a sidewall, an axial passage in fluid communication with the inner mandrel of the perforating gun, and a plurality of radial passages for directing pressurized well stimulation fluid into an annulus between the apparatus and the well casing above the annular seal. A check valve is located in the axial passage below the radial passages. The apparatus preferably includes a collar locator for detecting joint collars between sections of the well casing to permit a position of the apparatus to be tracked as the apparatus is moved up or down through the well casing. The apparatus also preferably includes a temperature sensor and a pressure sensor for measuring the downhole temperature and pressure during a well stimulation process.

In accordance with another aspect of the invention, there is provided a method for perforating and stimulating subterranean cased wells, comprising steps of perforating a selected section of the cased well by selectively firing charges from a perforating gun; and stimulating the selected section by pumping stimulation fluid down a fluid passage through the perforating gun and through perforations made by the selectively fired charges.

In accordance with yet another aspect of the invention, there is provided a method for perforating and stimulating subterranean cased wells, comprising steps of inserting a tool into a well, the tool including a perforating gun that carries vertically spaced apart charges that may be selectively fired for perforating the well casing, the perforating gun being adapted for connection to a tubing string and including a fluid passage to permit well stimulation fluid to be pumped therethrough, and an injection nozzle connected to an opposite end of the perforating gun in fluid communication with the fluid passage; positioning the tool in the well so that a selected number of the charges carried by the perforating gun are positioned within a selected section of a production zone to be stimulated; detonating the selected number of charges to perforate the well casing; pulling the tool upward until the injection nozzle is positioned in the selected section of the production zone; and pumping the well stimulation fluid through the tubing string, the fluid passage and the nozzle so that the well stimulation fluid is injected through the perforations in the well casing into the selected section of the production zone.

When more than one section of a cased well is to be perforated and stimulated, the above steps a)-e) are begun at a lowest section of the cased well and the well is treated in a staged upward progression. During each stage of the well treatment, the tool is first positioned to locate a selected group of charges in an area of the casing to be perforated. The selected group of charges are detonated to perforate the well casing and steps d) and e) are repeated until the stimulation of a production zone is completed. Steps b) to e) are then repeated for other production zones of the well. Remaining unused charges are selectively detonated until the entire perforation and stimulation of all selected sections of the well are completed, or all of the charges are spent. Finally, the tool is removed from the well.

The apparatus and method in accordance with the invention provide an improved solution for well completion. Perforation and stimulation of more than one section of the subterranean well is enabled without withdrawing and reinserting the toolstring between stimulation sessions for various sections of the well. As a result, the time required to complete a well is significantly reduced, and costs are correspondingly reduced.

Other features and advantages of the invention will be better understood with reference to preferred embodiments described below.

BRIEF DESCRIPTION OF THE DRAWINGS

Having thus generally described the nature of the invention, the invention will be further described in detail with reference to the accompanying drawings in which.

DETAILED DESCRIPTION OF THE PREFERRED EMBODIMENT

The invention provides a method and apparatus for performing staged perforation and stimulation of a cased well in a one-trip insertion of the apparatus into the well. The apparatus is a tool that includes a selective-shot perforating gun and a stimulation fluid injection nozzle connected to the perforating gun. The perforating gun is used to selectively perforate a section of the well casing. After the casing is perforated, the tool is pulled up until the injection nozzle is aligned with the perforations and stimulation fluid is pumped down through the perforating gun and the injection nozzle into a production zone through the perforations. The process is then repeated for a next section of the well, until all production zones are stimulated, or all the charges carried by the perforating gun are fired. This staged process ensures that all sections of a productive zone are more evenly fractured, while considerably reducing the time and cost of preparing a hydrocarbon well for production.

Figure 1:
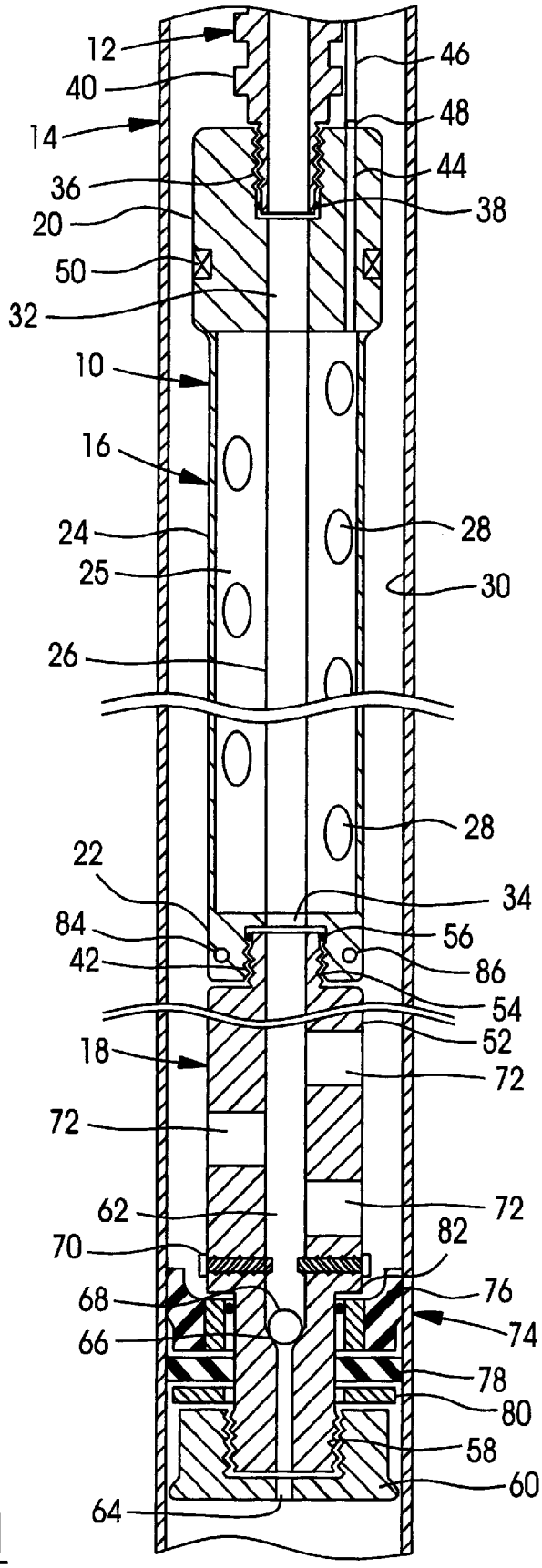
FIG. 1 is a schematic longitudinal sectional view of a well tool in accordance with one embodiment of the invention, connected to a tubing string in a cased well.

FIG. 1 schematically illustrates a well tool assembly in accordance with the invention, generally indicated by reference numeral 10. The well tool 10 is connected to a tubing string 12 in a cased well 14. The well tool assembly 10 includes a selective-shot perforating gun 16 and an injection nozzle 18 connected in series. The selective-shot perforating gun 16 includes a primer head 20 and nozzle adapter 22. An outer tubular sleeve 24 and an inner mandrel 26 are respectively connected to the primer head 20 and the nozzle adapter 22, and define an annulus 25 between the tubular sleeve 24 and the mandrel 26 for accommodating a plurality of perforating charges 28. The perforating charges 28 are axially spaced apart from one another and may be selectively fired to perforate a well casing 30. The charges 28 are supported in the annulus 25 and connected to respective primers and detonation conductors (not shown), to permit the charges 28 to be selectively detonated.

The primer head 20 includes a central bore 32 that is sealingly connected to a top end of the inner mandrel. The nozzle adapter 22 also includes a central bore 34 which is sealingly connected to a bottom end of the inner mandrel 26 so that the inner mandrel 26 in conjunction with the central bores 32 and 34 define a fluid passage that extends through the perforating gun 16 to permit well stimulation fluid to be pumped therethrough without contacting the charges 28. A threaded connector 36 and a seal ring 38 provide a high pressure fluid seal between the primer head 20 and a tubing string 12. In this embodiment, the connector 40 is a coil tubing hydraulic quick-connector and the tubing string 12 is a coil tubing string of 2⅜ inches. A threaded connector 42 is formed in the nozzle adapter 22 to facilitate connection of the injection nozzle 18.

A second passage 44 extends through the primer head. 20. to accommodate electrical conductors for detonating the charges 28, and for conducting various sensor signals, as will be explained below in more detail. The second passage 44 is adapted for the connection of a wireline, or a second small-diameter coil tubing (¾" coil tubing, for example) to accommodate the electrical conductors. A fluid tight seal 48 between the wireline or coil tubing 46 and the primer head 20 prevents fluid from infiltrating the annulus 25 so that the charges 28 are kept dry.

In order to track the position of the well tool 10 while it is inserted into the well 14, a collar locator 50 is preferably provided on the well tool 10. The collar locator 50 may be a mechanical type or an electronic type, each of which are well known in the art. The collar locator 50 may be incorporated into the well tool 10 at, for example, the primer head 20, or any other suitable location for detecting joint collars between sections of the well casing wall 30. The joint collars are counted to determine the location of the well tool 10 in the cased well 14, in a manner that is also well known in the art.

The injection nozzle 18 includes a side wall 52, a top threaded connector 54 that compresses an O-ring seal 56 for providing a high-pressure seal between the perforating gun 16 and the injection nozzle 18. The injection nozzle 18 further includes a bottom thread connector 58 for connection of a bull nose 60 for guiding the insertion of the well tool 10 when it is inserted into the cased well 14. An axial passage 62 extends through the injection nozzle 18 in fluid communication with the inner mandrel 26, and a center bore 64 of the bull nose 60. The axial passage 62 includes a lower section having a smaller diameter to form a valve seat 66 to receive a ball 68 of a ball valve. Two valve stops 70 axially spaced from the valve seat 66, extend through the sidewall 52 to limit upward movement of the ball 68. The ball 68 blocks the axial passage 62 to direct pressurized stimulation fluid into the annulus between the well casing 30 and the well tool 10. The radial passages 72 are axially spaced apart form one another. The radial passages may be spaced apart and oriented to correspond to the position and orientation of a repetitive pattern used to position the charges 28 in the perforating gun 10, although correspondence between the position of the axial passages 72 and the charges 28 is not required. The overall length of the injection nozzle is. preferably about 6–10 feet (2–3 meters), though other lengths may be used. The length of the perforating gun is preferably about 20 feet (6.3 meters), but longer or shorter lengths may be used, depending on the number of charges that are required to perforate a given well casing, for example.

An annular seal assembly 74 is connected to a lower end of the injection nozzle 18 to seal the annulus between the well tool 10 and the well casing 30 to inhibit pressurized stimulation fluid from flowing into the well 14 below the well tool 10. The annular seal assembly 74 includes a cup member 76, an annular rubber element 78 and a gauge ring 80. The annular seal assembly 74 is secured between the bull nose 60 and an annular shoulder 82 of the injection nozzle 18. The annular seal assembly 74 and the bull nose 60 are described in more detail in the Applicant's co-pending U.S. patent application Ser. No. 09/537,629 filed on Mar. 29, 2000, which is incorporated herein by reference.

In order to control a well stimulation process, it is desirable to know pressure and temperature at the stimulation fluid injection site. Pressure and temperature are routinely measured at the surface during a well stimulation operation, but for a number of reasons well understood in the art, surface measurements are often not indicative of downhole conditions. Downhole measurements permit a deduction of the porosity of a zone being stimulated, for example, and likewise enable the early detection of screenout, and the like. This permits remedial action to be taken early, saving time and materials. Consequently, the well tool 10 is preferably equipped with a pressure sensor 84, such as a pressure-sensing transducer, and temperature sensor 86, such as a temperature-sensing transducer. The pressure sensor 84 and the temperature sensor 86 respectively measure the instant pressure and temperature in the stimulation zone during a stimulation process. The pressure sensor 84 and the temperature sensor 86 may be incorporated into the well tool at any convenient location. For example at the nozzle adapter 22 of the perforating gun 16.

A method for performing a staged perforation and stimulation of selected sections of the cased well 14 using the well tool 10 is described below with reference to FIGS. 2–6.

Figure 2:
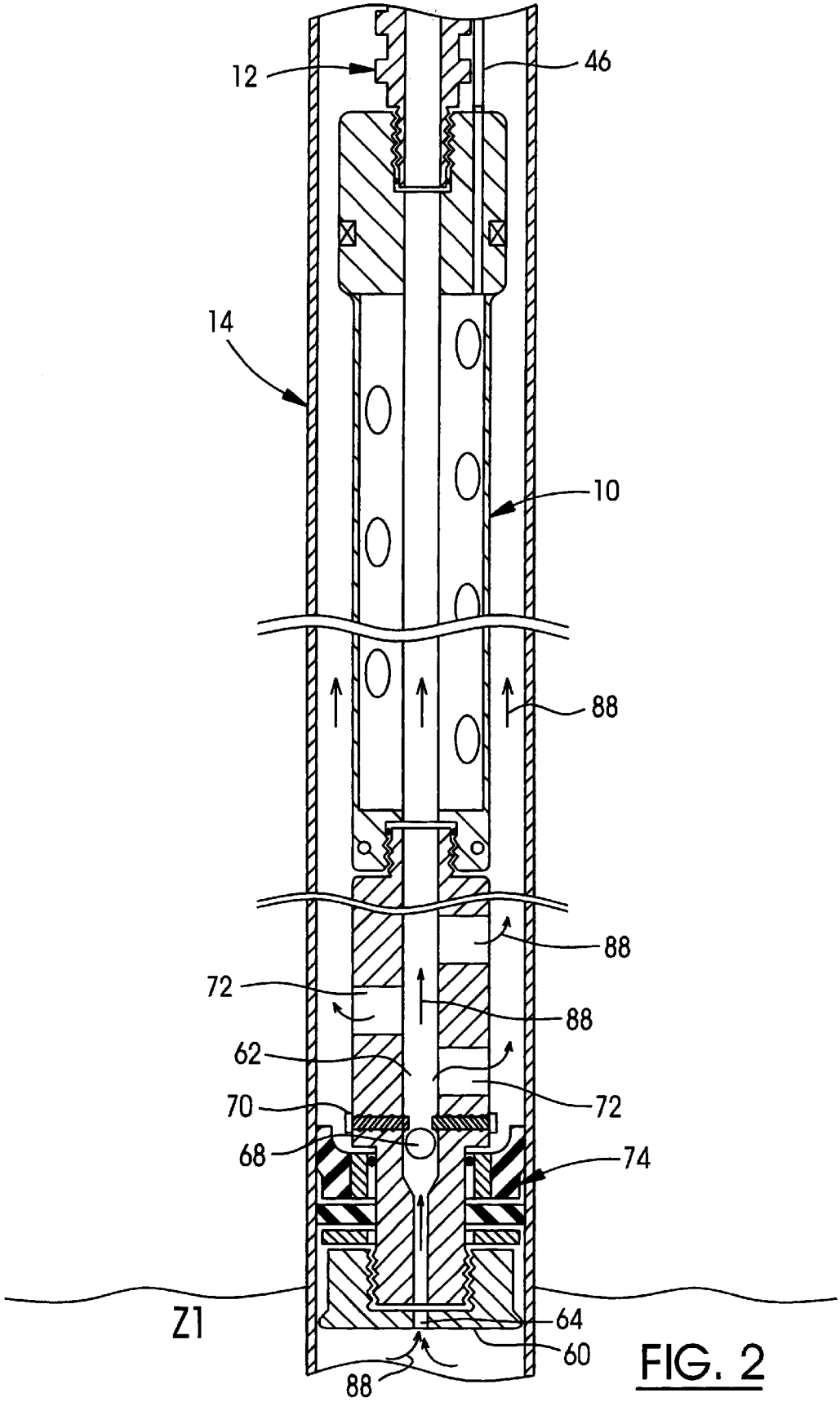
FIG. 2 through FIG. 6 are schematic views of the well tool shown in FIG. 1 in different stages of operation, illustrating a method of using the tool to perforate and stimulate a plurality of selected sections of the cased well.

FIG. 2 illustrates the well tool 10 being inserted into the cased well 14. Fluid in the cased well 14 below the well tool 10 is subject to pressure exerted by the downward movement of the well tool 10 because the annular seal assembly 74 blocks passage of the fluid around the well tool 10. Consequently, a build-up of fluid pressure in the center bore 64 of the bull nose 60 and the axial passage 62 of the injection nozzle 18 force the ball 68 up against the valve stops 70. The fluid flow illustrated by arrows 88 bypasses the annular seal assembly 74 through the axial passage 62 and radial passages 72 and fluid pressure in the wellbore is equalized as the well tool 10 is inserted into the cased well 14. At ground level, Applicant's stage fracturing tool assembly (not shown) may be used to provide an annulus valve (not shown) and pressure isolation if required. Applicant's stage fracturing tool assembly is described in co-pending U.S. patent application Ser. No. 09/493,802 filed Jan. 28, 2000. A dual string isolation tool (not shown) may also be used to run the main coil tubing string 12 through a packoff on one side and the wireline or the second coil tubing string 46 simultaneously. Applicant's dual string isolation tool is described in Applicant's U.S. patent application Ser. No. 09/268,460, filed on Mar. 16, 1999 and now allowed. As the well tool 10 is inserted into the well, the collar locator 50 (FIG. 1) is used to count the joint collars of the well casing 30, to provide an accurate indication of the location of the well tool 10 in the cased well 14.

Figure 3:
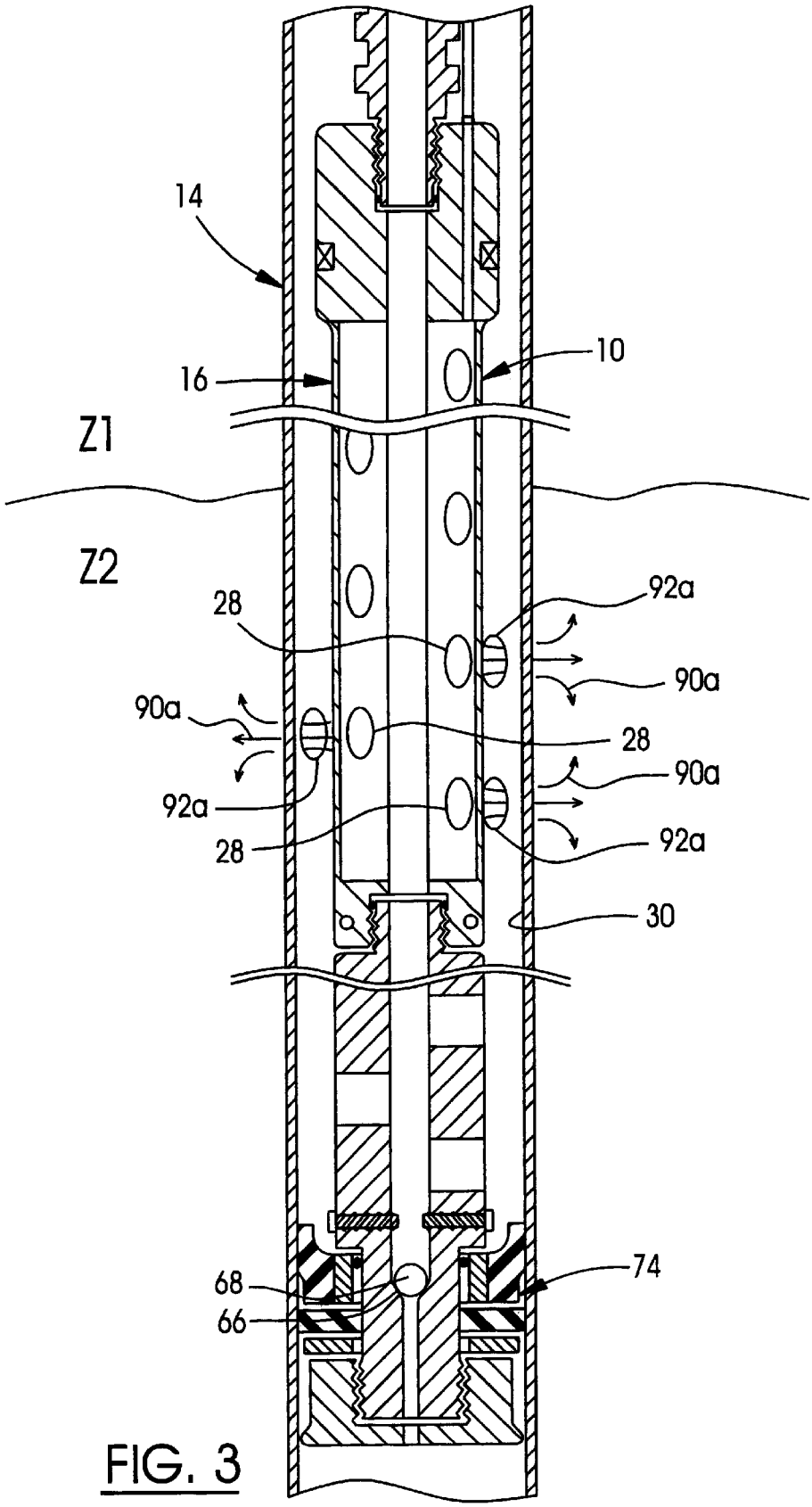
Figure 4:
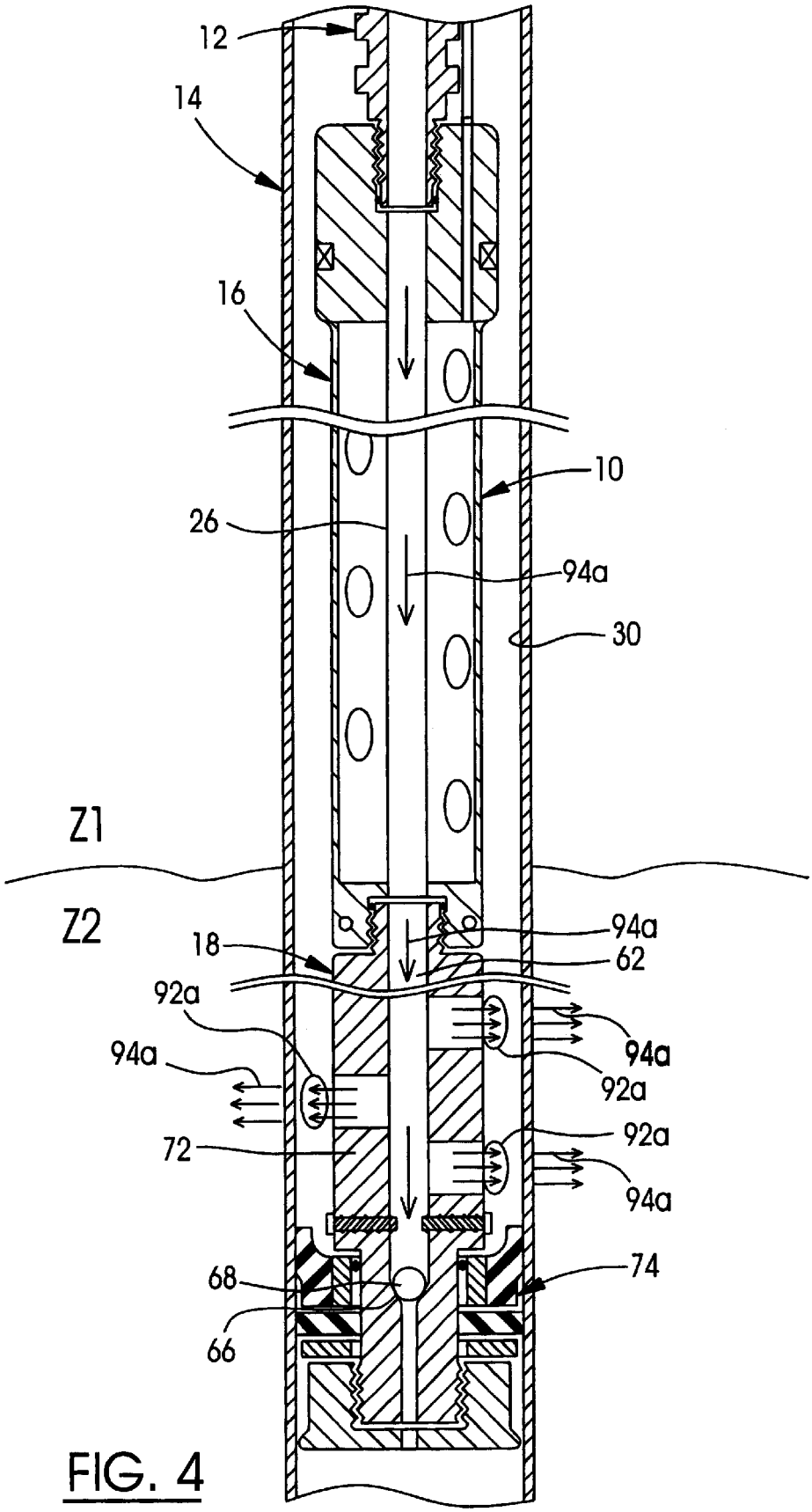

FIG. 3 illustrates the well tool 10 positioned in the cased well 14 so that a plurality of charges 28 (only 3 are shown) of the perforating gun 16 are located within a selected section of a production zone Z2. The fluid pressure above and below the annular seal assembly 74 is balanced and the ball 68 has returned to the valve seat 66 under its own weight, because the well tool 10 is no longer moving. The charges 28 are selectively detonated, and the explosive forces illustrated by arrows 90*a* create a first group of perforations 92*a* in the well casing 30. The number of charges detonated at each stage of a well stimulation operation is dependent on a number of factors. However, the length of the well casing 30 perforated at each stage is preferably not greater than a length of the injection nozzle 18. Preferably, the length of the well casing 30 that is perforated is equivalent to the length of the perforated portion of the injection nozzle 18, as shown in FIG. 4.

After the well casing is perforated by the selective firing of the perforating charges 28, as described above, the well tool 10 is pulled upwards in the well until the injection nozzle 18 is aligned with the perforations made in the well casing 30. In FIG. 4 illustrates the well tool 10 after it has been moved upwards to locate the radial passages 72 of the injection nozzle 18 in proximity with the perforations 92*a*. In order to prevent fluid pressure from building up in the cased well 14 above the annular seal assembly 74 when the well tool 10 is moved upwards, an annulus valve at ground level, if one is used, should be opened. The annulus valve is closed before highly pressurized stimulation fluid is pumped through the main coil tubing string 12 and the inner mandrel 26 of the perforating gun 16 into the axial passage 62 of the injection nozzle 18. The highly pressurized stimulation fluid illustrated by arrows 94*a* forces the ball 68 against the valve seat 66 and is ejected through the radial passages 72 of the injection nozzle 18 and the perforations 92*a* in the well casing 30 into the selected section of the production zone Z2. The temperature sensor 84 and the pressure sensor 86 (FIG. 1) provide real-time downhole pressure and temperature readings to assist the well stimulation crew in tracking and assessing the stimulation process. In the event of a screenout, the well tool 10 and the annulus above it are readily cleaned out without pulling the toolstring. This may be accomplished by opening annulus valves (not shown) at the surface and pumping gelled frac fluid down the coil tubing 12. The gelled frac fluid displaces the clogged proppants and forces them up through the annulus and out through the annulus valves. After a stimulation process has been completed normally, the annulus may be cleaned using the same procedure before the tool is moved to a new selected position in the cased well 14.

Figure 5:
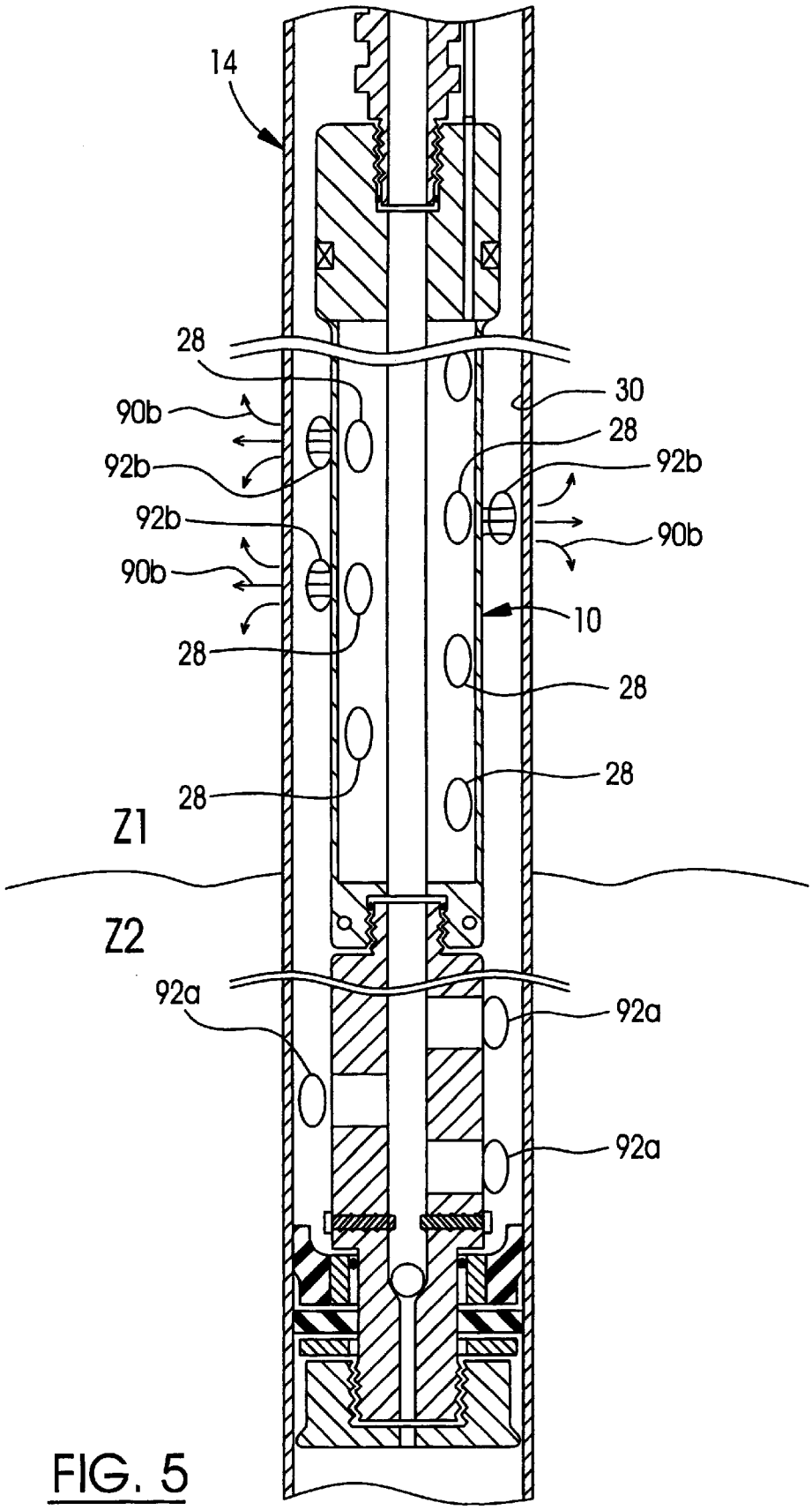

In accordance with the invention, the cased well 14 is preferably perforated and stimulated in a staged progression from a lowest point to be stimulated in the cased well 14. In other words, selected sections of the cased well 14 are perforated and stimulated in succession. The reason for doing so is explained below in more detail. The well tool 10 need not necessarily be moved to begin a next stage of perforation and stimulation of the next selected section of the oil well 14 if a next group of charges 28 to be detonated are located within the next selected section of the cased well 14, as shown in FIG. 5. Otherwise, the well tool 10 is moved to position the next group of charges in the selected section. As explained above, the annulus valve at ground level is opened when the well tool 10 is moved upwards in the cased well 14, and is closed during well stimulation. The next group of charges 28 are then detonated and the explosive forces indicated by arrows 90*b* produce perforations 92*b* in the well casing 30 and any cement surrounding the casing, as is well understood by those skilled in the art.

Figure 6:
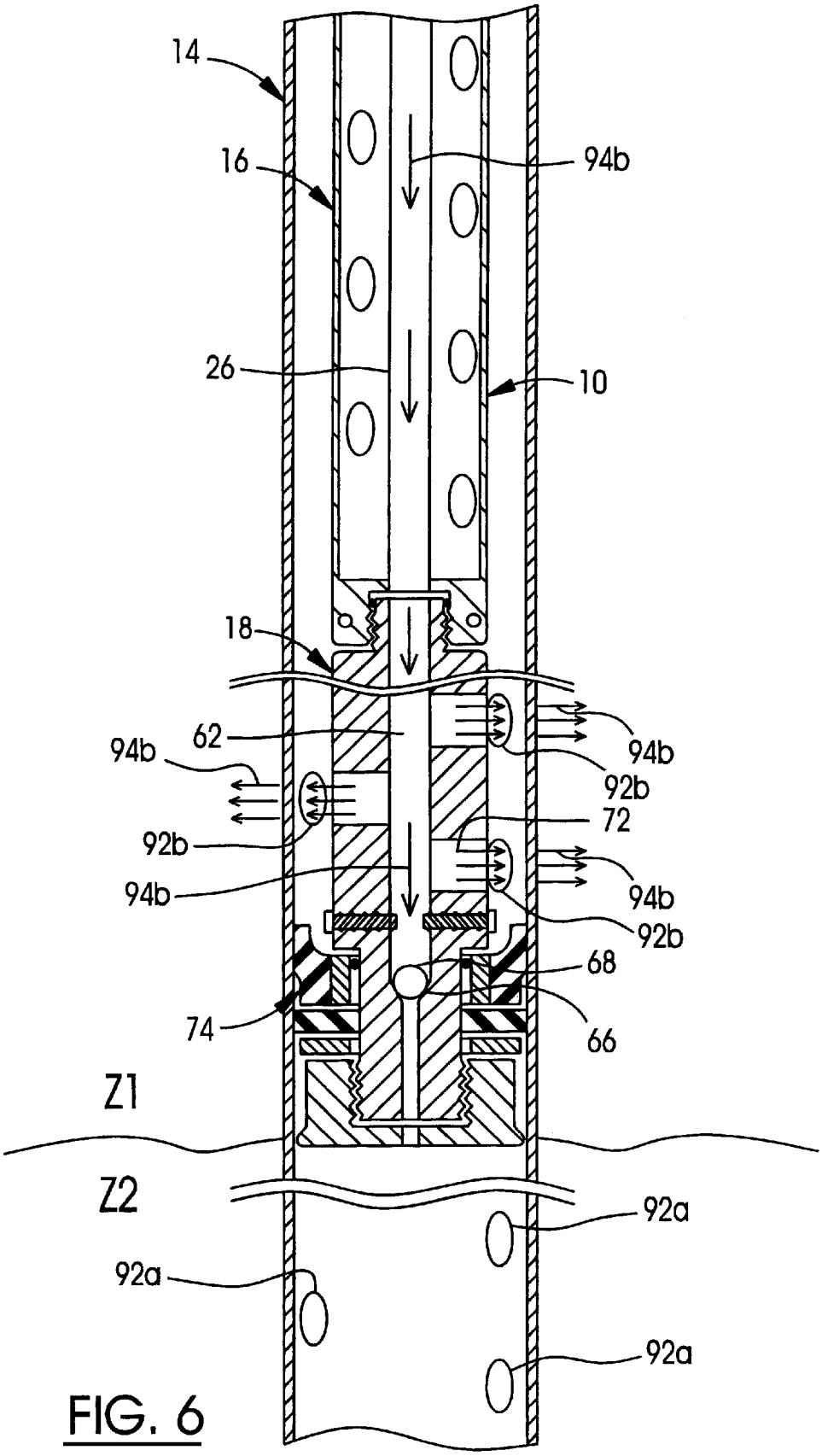

FIG. 6 illustrates the next stage of stimulation in which the well tool 10 is moved further upwards to position the radial passages 72 into alignment with the perforations 92*b*. Under the pressure induced by the pressurized stimulation fluid illustrated by arrows 94*b* that is pumped into the axial passage 62 of the injection nozzle 18 through the inner mandrel wall 26 of the perforating gun 16, the ball 68 is forced downwardly against the valve seat 66, as explained above, to inhibit the pressurized stimulation fluid 94*b* from entering the section of the cased well 14 below the annular seal assembly 74 so-that the stimulation pressure is maintained. The pressurized stimulation fluid 94*b* is injected through the radial passages 72 and the perforations 92*b*, into the selected section of the production zone Z1. The annular seal assembly 74, in combination with the ball 66, seals the passages between the selected section and the other lower sections so that the pressurized stimulation fluid 94*b* is prevented from entering the perforations 92*a* of the selected sections of the production zone Z2 that were previously stimulated. Since perforation and stimulation of the selected sections of the cased well 14 are performed in an upward progression, consistent stimulation of all zones is ensured. Even if stimulation fluids follow a path of least resistance to the lower perforations 92*a*, the only result will be a filling of the casing of the cased well 14 below the annular seal assembly 74. As soon as the casing is filled, stimulation pressure is exerted on the selected section being stimulated, and the section is fractured, as desired. Thus, the quality of the well stimulation is assured.

The process of perforation and stimulation is repeated, as required, until all zones of the cased well 14 are stimulated or the charges 14 are all detonated. If the charges are all detonated before stimulation of all production zones is complete, the toolstring is pulled from the well and the perforating gun is reloaded for another run into the wellbore.

The method and apparatus in accordance with the invention therefore overcome all known disadvantages of the prior art and enable a cased well 14 to be stimulated to prepare for production more quickly, reliably and efficiently than was achievable using prior art methods and apparatus.

The foregoing description is intended to be exemplary rather than limiting. The scope of the invention is therefore intended to be limited solely by the scope of the appended claims.

I claim:

1. An apparatus for perforating and stimulating subterranean wells comprising:

a) a perforating gun for perforating a well casing, the perforating gun being adapted for connection of a tubing string and including a fluid passage to permit well stimulation fluid to be pumped therethrough without affecting a functionality of components of the perforating gun; and b) an injection nozzle connected to a second end of the perforating gun in fluid communication with the fluid passage for injecting pressurized stimulation fluid into a production zone through perforations made through a casing of the well by the perforating gun, the injection nozzle including an axial passage having a check valve to permit fluid in the well below the annular seal to flow up through the nozzle when the apparatus is inserted into the well, while inhibiting the pressurized stimulation fluid from flowing through the nozzle into the section of the casing below the apparatus; and c) an annular seal for sealing an annulus between the apparatus and the well casing to prevent the pressurized stimulation fluid from flowing into the casing below the apparatus.

2. An apparatus as claimed in claim 1 wherein the tubing string is a coil tubing string.

3. An apparatus as claimed in claim 1 wherein the tubing string is a jointed tubing string.

4. An apparatus as claimed in claim 1, wherein the injection nozzle includes a sidewall surrounding an axial passage in fluid communication with the fluid passage through the perforating gun, and radial bores that extend through the sidewall to direct the pressurized stimulation fluid into the annulus between the apparatus and the well casing above the annular seal.

5. An apparatus as claimed in claim 4, wherein the radial bores are spaced and oriented to correspond with a spacing and orientation of charges in the perforating gun so that the radial bores align with perforations in the casing after the perforating gun is selectively fired and the apparatus is pulled a predetermined distance upwardly in the casing.

6. An apparatus as claimed in claim 4, further comprising a bull nose connected to a bottom end of the injection nozzle for guiding the apparatus within the well casing, the bull nose having an axial bore that extends therethrough in fluid communication with the axial passage in the injection nozzle.

7. An apparatus as claimed in claim 4, wherein the check valve is located in the axial passage below the radial bores.

8. An apparatus as claimed in claim 7, wherein the check valve is a ball valve with a stop member to limit movement of the ball away from a seat of the valve.

9. An apparatus as claimed in claim 1, wherein charges of the perforating gun are adapted to be selectively detonated.

10. An apparatus as claimed in claim 1, wherein the perforating gun includes an outer tubular wall and an inner tubular wall, and an annulus defined between the outer and inner tubular walls for accommodating the charges.

11. An apparatus as claimed in claim 1, wherein the perforating gun is adapted for sealing connection of a coil tubing string that is inserted into the casing alongside of the tubing string, the coil tubing string protecting conductors being used to detonate the charges carried by the perforating gun.

12. An apparatus as claimed in claim 1, further comprising a collar locator for detecting joint collars between sections of the well casing wall to permit a location of the apparatus to be determined as the apparatus is moved down through the casing.

13. An apparatus as claimed in claim 1, further comprising a pressure sensor for measuring a pressure in the casing when the pressurized stimulation fluid is pumped into the casing during a stimulation process.

14. An apparatus as claimed in claim 1, further comprising a temperature sensor for measuring a temperature in the casing when the pressurized stimulation fluid is pumped into the casing during a stimulation process.

15. A method for perforating and stimulating subterranean cased wells, comprising steps of:

a) perforating a selected section of the cased well by selectively firing charges from a perforating gun; and b) pulling the perforating gun upwards until an injection nozzle connected to a lower end of the perforating gun is positioned in the selected section of the production zone, and stimulating the selected section by pumping stimulation fluid down a fluid passage through the perforating gun and through perforations made by the selectively fired charges.

16. A method as claimed in claim 15, wherein steps a) and b) are performed in a sequence starting from a lowest production zone of the cased well and progressing upwards.

17. A method as claimed in claim 16, wherein the stimulation fluid is directed radially by an injection nozzle connected to a lower end of the perforating gun.

18. A method as claimed in claim 17, wherein a tubing string is connected to an upper end of the perforating gun to provide a conduit for stimulation fluid supply, and for moving the perforating gun and the injection nozzle in the cased well.

19. A method as claimed in claim 18, further comprising using a secondary tubing string connected to the perforating gun to protect conductors for controlling the selective firing of the charges.

20. A method for perforating and stimulating subterranean cased wells, comprising steps of:

a) inserting a tool into a well, the tool including a perforating gun that carries vertically spaced apart charges that may be selectively fired for perforating the well casing, the perforating gun being adapted for connection to a tubing string and including a fluid passage to permit well stimulation fluid to be pumped therethrough, and an injection nozzle connected to an opposite end of the perforating gun in fluid communication with the fluid passage;

b) positioning the tool in the well so that a selected number of the charges carried by the perforating gun are positioned within a selected section of a production zone to be stimulated;

c) detonating the selected number of charges to perforate the well casing;

d) pulling the tool upward until the injection nozzle is positioned in the selected section of the production zone; and e) pumping the well stimulation fluid through the tubing string, the fluid passage and the nozzle so that the well stimulation fluid is injected through the perforations in the well casing into the selected section of the production zone.

21. A method as claimed in claimed 20, comprising further steps of:

f) moving the tubing string to position the tool in the well so that a second selected number of charges carried by the perforating gun are positioned in another selected section of a production zone in the cased well;

g) detonating the second selected number of charges to perforate the well casing;

h) repeating the steps d) and e) to stimulate the other selected section of the production zone; and i) repeating the steps b) to e) for other sections of the cased well, until all sections of each production zone to be stimulated is completed, or all of the charges are spent; and j) removing the tool from the cased well.

22. A method as claimed in claim 20, wherein the selective detonation is effected using conductors protected by a coil tubing sealingly connected to the tool, the coil tubing extending alongside of the tubing string in the cased well.

23. A method as claimed in claim 20, wherein the tool further includes an annular seal for sealing an annulus between the tool and the well casing below the injection nozzle.

24. A method as claimed in claim 23, wherein the tool further includes a check valve installed in the injection nozzle to permit fluid trapped in the cased well below the annular seal to flow up through the injection nozzle as the tool is inserted into the cased well to facilitate the insertion of the tool into the well.

* * * * *